US007448560B2

(12) United States Patent
Sayar

(10) Patent No.: US 7,448,560 B2
(45) Date of Patent: Nov. 11, 2008

(54) UNITARY FLUIDIC FLOW CONTROLLER ORIFICE DISC FOR FUEL INJECTOR

(75) Inventor: Hamid Sayar, Newport News, VA (US)

(73) Assignee: Continental Automotive Systems US, Inc., Auburn Hills ( * ) Notice: Subject to any disclaimer, the term of this patent is extended or adjusted under 35 U.S.C. 154(b) by 799 days.

(21) Appl. No.: 10/972,864

(22) Filed: Oct. 26, 2004

(65) Prior Publication Data

US 2005/0087630 A1 Apr. 28, 2005

Related U.S. Application Data

(60) Provisional application No. 60/514,779, filed on Oct. 27, 2003.

(51) Int. Cl.
*B05B 1/14* (2006.01)

(52) U.S. Cl. ..... 239/596; 239/533.12; 239/601

(58) Field of Classification Search ..... 239/5, 239/533.12, 502, 522, 596, 533.2, 598, 601, 239/497, 494; 29/557, 888.4
See application file for complete search history.

(56) References Cited

U.S. PATENT DOCUMENTS

| | | | | |
|---|---|---|---|---|
| 1,693,931 | A | 12/1928 | Lowe | |
| 2,493,209 | A | 1/1950 | Simmons | |
| 4,040,396 | A | 8/1977 | Tomita | |
| 5,437,413 | A * | 8/1995 | Shen et al. | 239/424.5 |
| 5,586,726 | A | 12/1996 | Furuya et al. | |
| 6,065,691 | A | 5/2000 | West | |
| 6,065,692 | A | 5/2000 | Brinn, Jr. | |
| 6,089,473 | A * | 7/2000 | Keim | 239/533.12 |
| 6,102,299 | A | 8/2000 | Pace et al. | |
| 6,161,782 | A | 12/2000 | Heinbuck et al. | |
| 6,357,677 | B1 | 3/2002 | Ren et al. | |
| 6,499,974 | B2 * | 12/2002 | Bach | 239/407 |
| 6,848,635 | B2 * | 2/2005 | Xu | 239/533.12 |
| 6,854,670 | B2 * | 2/2005 | Sumisha et al. | 239/543 |
| 7,093,776 | B2 * | 8/2006 | Schneider | 239/533.12 |
| 7,222,407 | B2 * | 5/2007 | Sayar | 29/558 |
| 7,299,997 | B2 * | 11/2007 | Sayar | 239/5 |
| 7,306,172 | B2 * | 12/2007 | Sayar | 239/533.14 |
| 7,344,090 | B2 * | 3/2008 | Sayar | 239/5 |
| 2002/0074431 | A1 * | 6/2002 | Ren et al. | 239/407 |
| 2003/0141385 | A1 * | 7/2003 | Xu | 239/463 |
| 2003/0234005 | A1 * | 12/2003 | Sumisha et al. | 123/467 |
| 2003/0234302 | A1 | 12/2003 | Varble et al. | |

(Continued)

OTHER PUBLICATIONS

Malvern Products, Spraytec Droplet Size Analyzer, www.malvern.co.uk, Oct. 19, 2004, pp. 1-3.

*Primary Examiner*—Len Tran
*Assistant Examiner*—Daniel T Sharpe

(57) ABSTRACT

A fuel injector is described. The fuel injector includes an inlet, outlet, seat, closure member, and a metering orifice disc. The metering orifice disc is disposed between the seat and the outlet. The metering orifice disc includes: a generally planar surface, a plurality of metering orifices that extends through the generally planar surface, the metering orifices being located radially outward of the seat orifice; and at least one flow channel having a cross-sectional area that decreases in magnitude starting at a location spaced from the longitudinal axis to proximate a perimeter of a metering orifice. A seat subassembly and a metering orifice disc are described. And a method of atomizing fuel is also described.

25 Claims, 6 Drawing Sheets

U.S. PATENT DOCUMENTS

2005/0087626 A1* 4/2005 Sayar ..... 239/533.12
2005/0087627 A1* 4/2005 Sayar ..... 239/533.12
2005/0087628 A1* 4/2005 Sayar ..... 239/533.12
2005/0087629 A1* 4/2005 Sayar ..... 239/533.12
2005/0087630 A1* 4/2005 Sayar ..... 239/533.12
2005/0103900 A1* 5/2005 Varble et al. ..... 239/533.12
2005/0121543 A1* 6/2005 Sayar ..... 239/533.12
2005/0284965 A1* 12/2005 Schneider ..... 239/533.12

* cited by examiner

UNITARY FLUIDIC FLOW CONTROLLER ORIFICE DISC FOR FUEL INJECTOR

This application claims the benefits of U.S. provisional patent application Ser. No. 60/514,779 entitled "Fluidic Flow Controller Orifice Disc," filed on Oct. 27, 2003 which provisional patent application is incorporated herein by reference in its entirety into this application.

BACKGROUND OF THE INVENTION

Most modern automotive fuel systems utilize fuel injectors to provide precise metering of fuel for introduction into each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The metering and atomization of the fuel reduces combustion emissions and increases the fuel efficiency of the engine. Thus, as a general rule, the greater the precision in metering and targeting of the fuel and the greater the atomization of the fuel, the lower the emissions with greater fuel efficiency.

An electro-magnetic fuel injector typically utilizes a solenoid assembly to supply an actuating force to a fuel metering assembly. Typically, the fuel metering assembly is a plunger-style closure member which reciprocates between a closed position, where the closure member is seated in a seat to prevent fuel from escaping through a metering orifice into the combustion chamber, and an open position, where the closure member is lifted from the seat, allowing fuel to discharge through the metering orifice for introduction into the combustion chamber.

The fuel injector is typically mounted upstream of the intake valve in the intake manifold or proximate a cylinder head. As the intake valve opens on an intake port of the cylinder, fuel is sprayed towards the intake port. In one situation, it may be desirable to target the fuel spray at the intake valve head or stem while in another situation, it may be desirable to target the fuel spray at the intake port instead of at the intake valve. In both situations, the targeting of the fuel spray can be affected by the spray or cone pattern. Where the cone pattern has a large divergent cone shape, the fuel sprayed may impact on a surface of the intake port rather than towards its intended target. Conversely, where the cone pattern has a narrow divergence, the fuel may not atomize and may even recombine into a liquid stream. In either case, incomplete combustion may result, leading to an increase in undesirable exhaust emissions.

Complicating the requirements for targeting and spray pattern is cylinder head configuration, intake geometry and intake port specific to each engine's design. As a result, a fuel injector designed for a specified cone pattern and targeting of the fuel spray may work extremely well in one type of engine configuration but may present emissions and driveability issues upon installation in a different type of engine configuration. Additionally, as more and more vehicles are produced using various configurations of engines (for example: inline-4, inline-6, V-6, V-8, V-12, W-8 etc.,), emission standards have become stricter, leading to tighter metering, spray targeting and spray or cone pattern requirements of the fuel injector for each engine configuration. Thus, it is believed that there is a need in the art for a fuel injector that would alleviate the drawbacks of the conventional fuel injector in providing spray targeting and atomizing of fuel flow with minimal modification of a fuel injector.

SUMMARY OF THE INVENTION

The present invention provides a fuel injector that includes an inlet, outlet, seat, closure member, and a metering orifice disc. The inlet and outlet include a passage extending along a longitudinal axis from the inlet to the outlet, the inlet being communicable with a flow of fuel. The seat is disposed in the passage proximate the outlet. The seat includes a sealing surface that faces the inlet and a seat orifice extending through the seat from the sealing surface along the longitudinal axis A-A. The closure member is reciprocally located between a first position displaced from the seat, and a second position contiguous the sealing seat surface of the seat to form a seal that precludes fuel flow past the closure member. The metering orifice disc is disposed between the seat and the outlet. The metering orifice disc includes: a generally planar surface, a plurality of metering orifices that extends through the generally planar surface, and first and second walls. The plurality of metering orifices extends through the generally planar surface. The metering orifices are located radially outward of the seat orifice, and each of the metering orifices has a center defined by the interior surface of the metering orifice through the disc. The first wall has a first inner wall portion closest to the longitudinal axis and a first outer wall portion closest to the center of the metering orifice. The second wall has a perimeter disposed about the longitudinal axis A-A. The second wall includes a plurality of projections that extend from the perimeter. Each projection has a base and a free end. The base is contiguous to the perimeter to define a second inner wall portion. The base confronts the first wall to define two channels that converge towards each metering orifice, each channel including a first distance between the first inner wall portion and second inner wall portion being greater than a second distance between the first outer wall portion and second outer wall portion.

In yet a further aspect of the present invention, a method of atomizing fuel flow through at least one metering orifice of a fuel injector is provided. The fuel injector has an inlet and an outlet and a passage extending along a longitudinal axis therethrough the inlet and outlet. The outlet has a closure member, seat and a metering orifice disc. The seat has a seat orifice. The closure member occludes a flow of fuel through seat orifice. The metering orifice disc being disposed between the seat and the outlet. The metering orifice disc includes at least one metering orifice that extends along the longitudinal axis through the generally planar surface to define a centerline. The method can be achieved by: flowing a portion of the fuel to a first surface of the metering orifice disc closest to the closure member; directing the portion of the fuel to the generally planar surface area spaced from the first surface and farther from the closure member; and flowing the portion of fuel away from the longitudinal axis to the at least one metering orifice through two flow channels, each channel having a first cross-sectional area located proximate the longitudinal axis and a second cross-sectional area spaced farther away from the longitudinal axis, the second cross-sectional area being smaller than the first cross-sectional area.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1A:
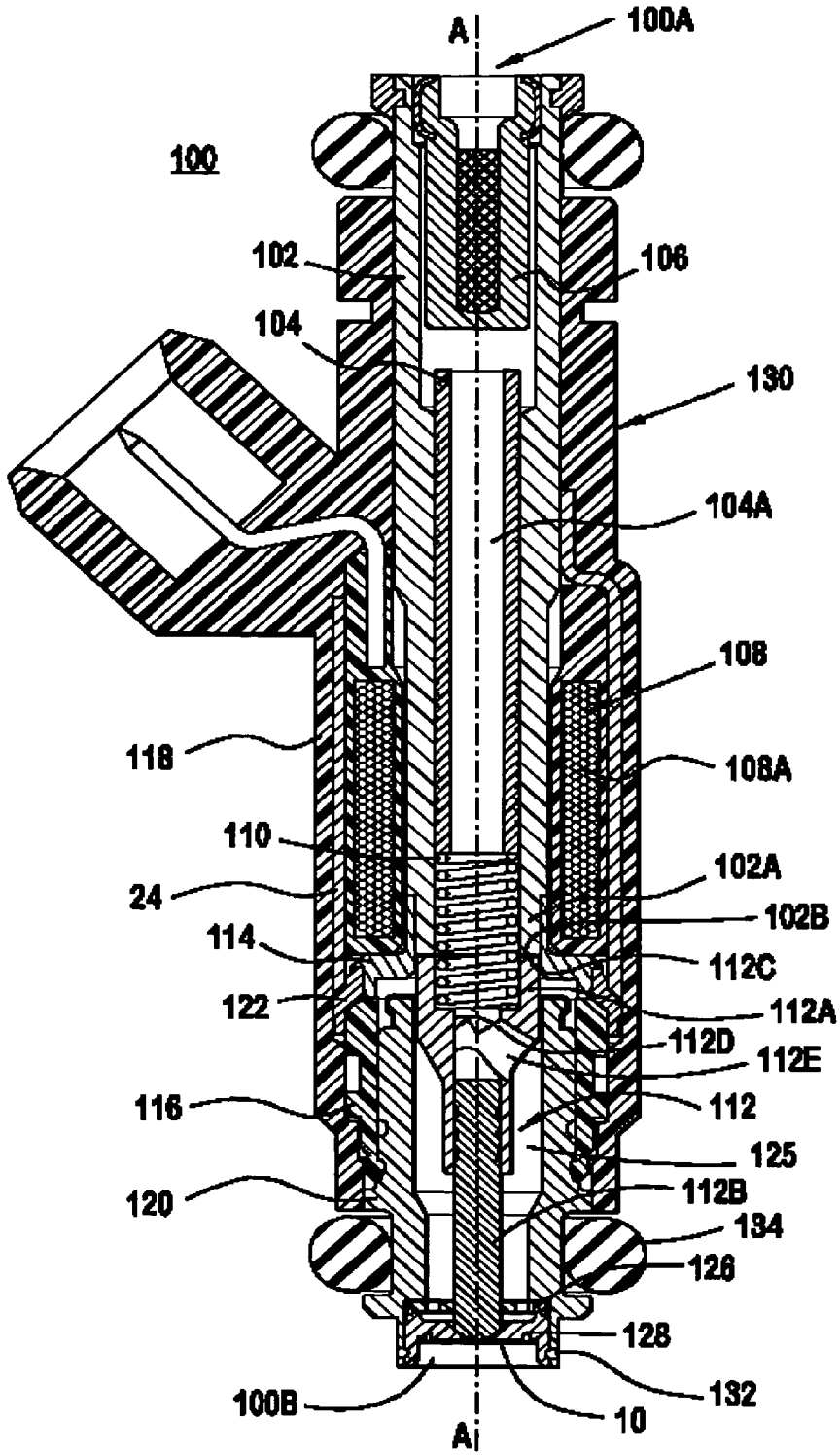
FIG. 1A illustrates a cross-sectional view of the fuel injector for use with the metering orifice discs of FIGS. 2A and 2C.
Figure 1B:
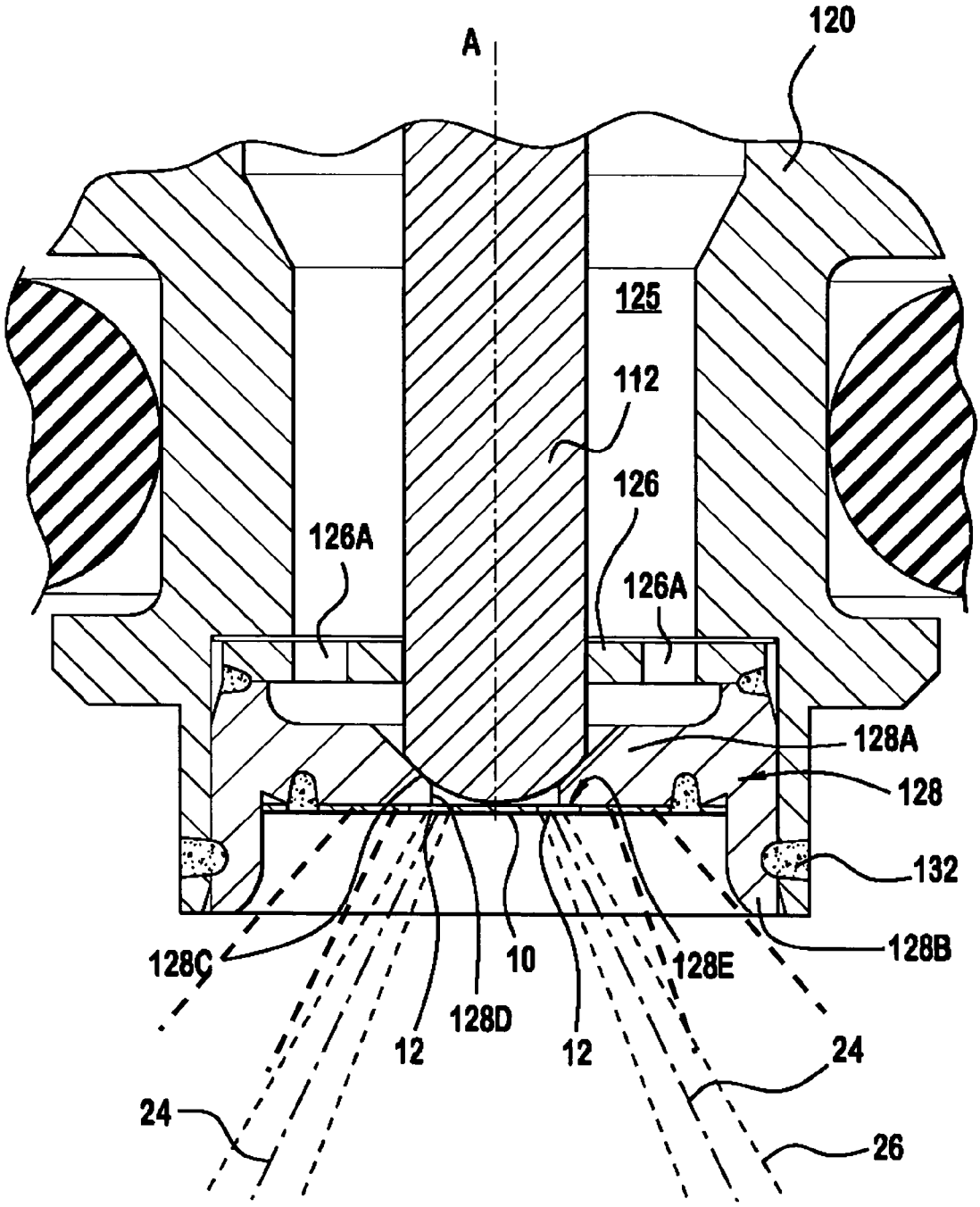
FIG. 1B illustrates a close-up cross-sectional view of the fuel outlet end of the fuel injector of FIG. 1A.
Figure 2A:
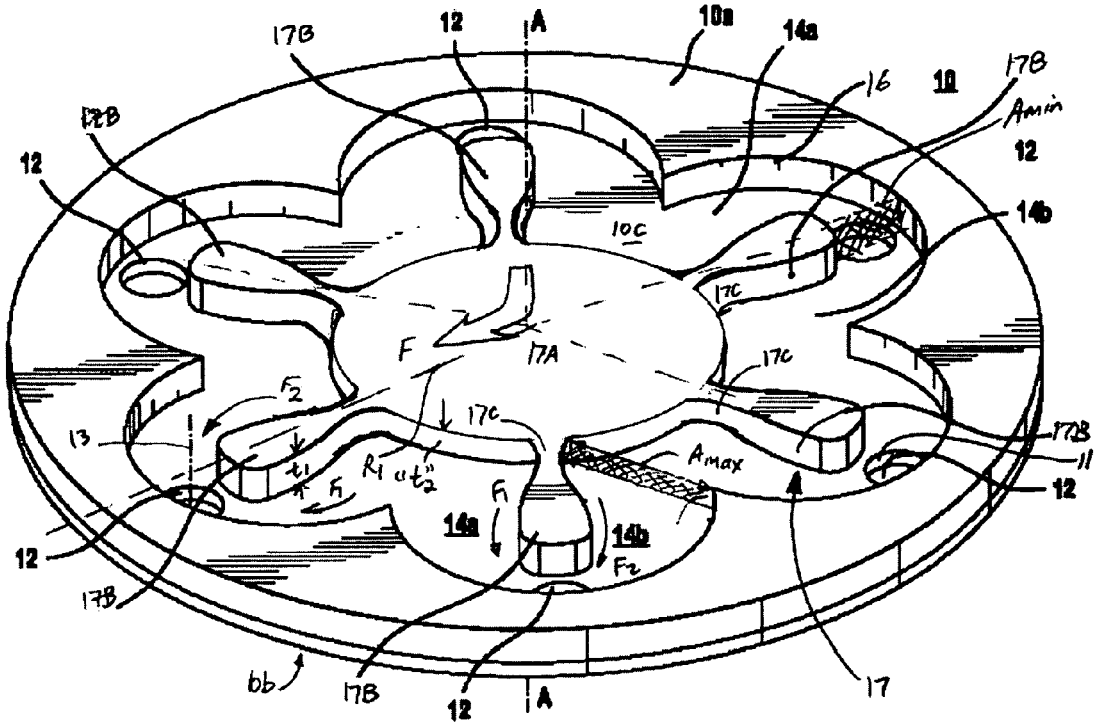
FIG. 2A illustrates a perspective view of a preferred embodiment of a metering orifice disc for use in a fuel injector of FIG. 1A.
Figure 2B:
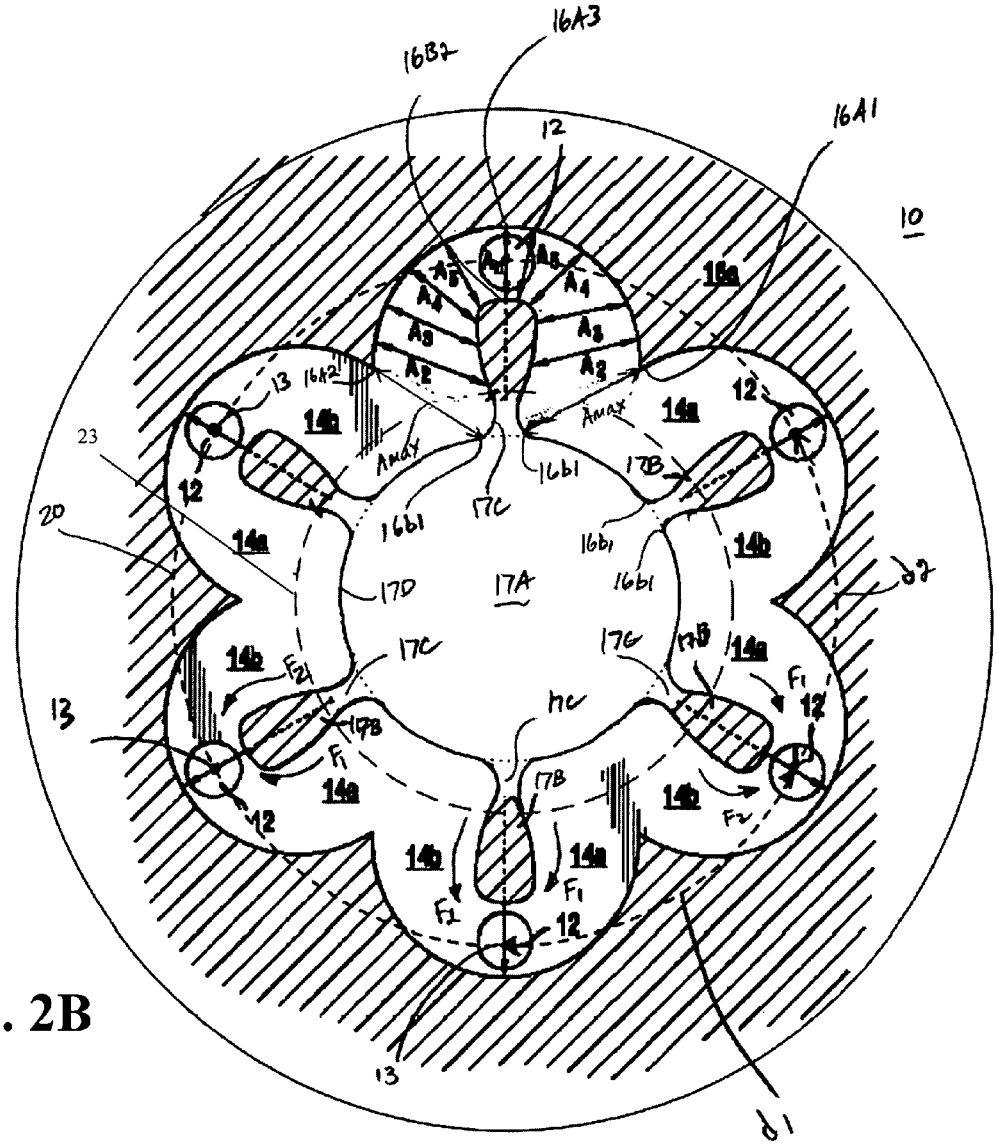
FIG. 2B illustrates a plan view of the metering orifice disc of FIG. 2A.
Figure 2C:
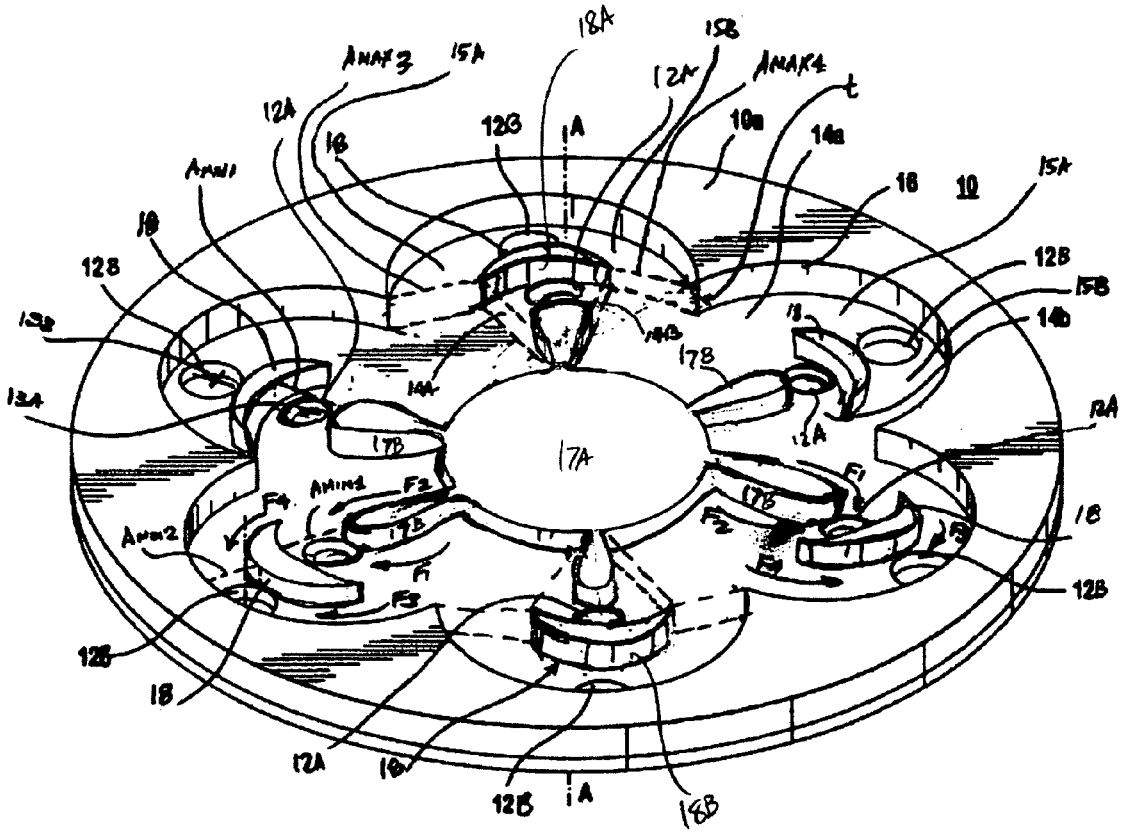
FIGS. 2C illustrates a perspective view of another preferred embodiment of a metering orifice disc for use in the fuel injector of FIG. 1A.

FIGS. 1-2 illustrate the preferred embodiments, including, as illustrated in FIG. 1A, a fuel injector 100 that utilizes a metering orifice disc 10 of FIG. 2A or 2C located proximate the outlet of the fuel injector 100.

As shown in FIG. 1A, the fuel injector 100 has a housing that includes an inlet tube 102, adjustment tube 104, filter assembly 106, coil assembly 108, biasing spring 110, armature assembly 112 with an armature 112A and closure member 112B, non-magnetic shell 114, a first overmold 116, second overmold 118, a body 120, a body shell 122, a coil assembly housing 124, a guide member 126 for the closure member 112A, a seat assembly 128, and the metering orifice disk 10.

Armature assembly 112 includes a closure member 112A. The closure member 112A can be a suitable member that provides a seal between the member and a sealing surface 128C of the seat assembly 128 such as, for example, a spherical member or a closure member with a hemispherical surface. Preferably, the closure member 112A is a closure member with a generally hemispherical end. The closure member 112A can also be a one-piece member of the armature assembly 112.

Coil assembly 120 includes a plastic bobbin on which an electromagnetic coil 122 is wound. Respective terminations of coil 122 connect to respective terminals that are shaped and, in cooperation with a surround 118A, formed as an integral part of overmold 118, to form an electrical connector for connecting the fuel injector 100 to an electronic control circuit (not shown) that operates the fuel injector 100.

Inlet tube 102 can be ferromagnetic and includes a fuel inlet opening at the exposed upper end. Filter assembly 106 can be fitted proximate to the open upper end of adjustment tube 104 to filter any particulate material larger than a certain size from fuel entering through inlet opening 100A before the fuel enters adjustment tube 104.

In the calibrated fuel injector 100, adjustment tube 104 can be positioned axially to an axial location within inlet tube 102 that compresses preload spring 110 to a desired bias force. The bias force urges the armature/closure to be seated on seat assembly 128 so as to close the central hole through the seat. Preferably, tubes 110 and 112 are crimped together to maintain their relative axial positioning after adjustment calibration has been performed.

After passing through adjustment tube 104, fuel enters a volume that is cooperatively defined by confronting ends of inlet tube 102 and armature assembly 112 and that contains preload spring 110. Armature assembly 112 includes a passageway 112E that communicates volume 125 with a passageway 104A in body 130, and guide member 126 contains fuel passage holes 126A. This allows fuel to flow from volume 125 through passageways 112E to seat assembly 128, shown in the close-up of FIG. 1B.

In FIG. 1B, the seat assembly 128 includes a seat body 128A with a seat extension 128B. The seat extension 128B can be coupled to the body 120 with a weld 132 that is preferably welded from an outer surface of the body 120 to the seat extension 128B. The seat body 128A is coupled to a guide disc 126 with flow openings 126A. The seat body 128A includes a seat orifice 128D, preferably having a right-angle cylindrical wall surface with a generally planar face 128E at the bottom of the seat body 128A. The seat body 128A is coupled to the metering orifice disc 10 by a suitable attachment technique, preferably by a weld extending from the second surface 10B of the disc 10 through first surface 10A and into the generally planar face 128E of the seat body 128A. The guide disk 126, seat body 128A and metering orifice disc 10 can form the seat assembly 128, which is coupled to the body 120. Preferably, the seat body 128A and the metering orifice disc 10 form the seat assembly 128. It should be noted here that both the valve seat assembly 128 and metering orifice disc 10 can be attached to the body 120 by a suitable attachment technique, including, for example, laser welding, crimping, and friction welding or conventional welding.

Referring back to FIG. 1A, non-ferromagnetic shell 114 can be telescopically fitted on and joined to the lower end of inlet tube 102, as by a hermetic laser weld. Shell 114 has a tubular neck that telescopes over a tubular neck at the lower end of inlet tube 102. Shell 114 also has a shoulder that extends radially outwardly from neck. Body shell 122 can be ferromagnetic and can be joined in fluid-tight manner to non-ferromagnetic shell 114, preferably also by a hermetic laser weld.

The upper end of body 130 fits closely inside the lower end of body shell 122 and these two parts are joined together in fluid-tight manner, preferably by laser welding. Armature assembly 112 can be guided by the inside wall of body 130 for axial reciprocation. Further axial guidance of the armature/closure member assembly can be provided by a central guide hole in member 126 through which closure member 112A passes. Surface treatments can be applied to at least one of the end portions 102B and 112C to improve the armature's response, reduce wear on the impact surfaces and variations in the working air gap between the respective end portions 102B and 112C.

According to a preferred embodiment, the magnetic flux generated by the electromagnetic coil 108A flows in a magnetic circuit that includes the pole piece 102A, the armature assembly 112, the body 120, and the coil housing 124. The magnetic flux moves across a side airgap between the homogeneous material of the magnetic portion or armature 112A and the body 120 into the armature assembly 112 and across a working air gap between end portions 102B and 112C towards the pole piece 102A, thereby lifting the closure member 112B away from the seat assembly 128. Preferably, the width of the impact surface 102B of pole piece 102A is greater than the width of the cross-section of the impact surface 112C of magnetic portion or armature 112A. The smaller cross-sectional area allows the ferro-magnetic portion 112A of the armature assembly 112 to be lighter, and at the same time, causes the magnetic flux saturation point to be formed near the working air gap between the pole piece 102A and the ferro-magnetic portion 112A, rather than within the pole piece 102A.

The first injector end 100A can be coupled to the fuel supply of an internal combustion engine (not shown). The O-ring 134 can be used to seal the first injector end 100A to the fuel supply so that fuel from a fuel rail (not shown) is supplied to the inlet tube 102, with the O-ring 134 making a fluid tight seal, at the connection between the injector 100 and the fuel rail (not shown).

In operation, the electromagnetic coil 108A is energized, thereby generating magnetic flux in the magnetic circuit. The magnetic flux moves armature assembly 112 (along the axis A-A, according to a preferred embodiment) towards the integral pole piece 102A, i.e., closing the working air gap. This movement of the armature assembly 112 separates the closure member 112B from the sealing surface 128C of the seat assembly 128 and allows fuel to flow from the fuel rail (not shown), through the inlet tube 102, passageway 104A, the through-bore 112D, the apertures 112E and the body 120, between the seat assembly 128 and the closure member 112B, through the opening, and finally through the metering orifice disc 10 into the internal combustion engine (not shown). When the electromagnetic coil 108A is de-energized, the armature assembly 112 is moved by the bias of the resilient member 226 to contiguously engage the closure member 112B with the seat assembly 128, and thereby prevent fuel flow through the injector 100.

Referring to FIG. 2A, a perspective view of a preferred metering orifice disc 10 that utilizes a unitary flow divider is illustrated. In this embodiment, a first metering disk surface 10A is provided with an oppositely facing second metering disk surface 10B. A longitudinal axis A-A extends through both surfaces 10A and 10B of the metering orifice disc 10. A plurality of metering orifices 12 is formed through the metering orifice disc 10 on a recessed third surface 10C having a recessed distance "t1" from a top surface of projection 17B of a unitary flow divider structure 17. The metering orifices 12 are preferably located radially outward of the longitudinal axis and extend through the metering orifice disc 10 along the longitudinal axis so that the internal wall surface of the metering orifice defines a center 13 of the metering orifice 12. Although the metering orifices 12 are illustrated preferably as having the same configuration, other configurations are possible such as, for example, a non-circular flow opening with different sizes of the flow opening for one or more metering orifices.

The unitary flow divider structure 17 can be provided with a member 17A that has a thickness "t2." The thickness t2 can be provided to reduce the "sac volume" between the seat orifice and the metering disc surface 10C, which is believed to be an advantage for the fuel injector 100. As known to those skilled in the art, a "sac volume" is defined as a volume downstream of a closure member against the sealing surface and upstream of the metering orifices. By providing this member 17A whose surface is closest to the closure member, the sac volume is reduced while causing the fuel flow through the seat orifice 128D to be directed towards the flow channels in conjunction with the third surface 10C. Preferably, the thickness "t2" can be the same as the thickness "t1" of the projection 17.

The metering orifice disc 10 includes two flow channels 14A and 14B provided by two walls 16 and 17B. A first wall 16 surrounds a portion of the metering orifices 12. A second wall 17B, acting as a flow divider, is disposed between each metering orifice and the longitudinal axis A-A. The first wall 16 surrounds at least one metering orifice and at least the second wall 17B. The second wall 17B is preferably in the form of a generally teardrop shape but can be any suitable shape as long as the second wall 17B divides a fuel flow proximate the longitudinal axis A-A into two flow channels 14A and 14 and recombine the fuel flow proximate the metering orifice 12 at a higher velocity than as compared to the velocity of the fuel at the beginning of the second wall 17B. The member 17A can be connected to the second wall 17B by a transition portion 17C by a suitable technique. Preferably, the member 17A, second wall 17B, and transition portion 17C are unitary or monolithic in construction as flow divider structure 17 so that, in addition to reducing the sac volume, structural integrity is believed to be enhanced for each of the second wall 17B against fuel pressure pulsations. In the preferred embodiment, the unitary member 17A has an inner portion 17D defining a generally circular perimeter smaller than a virtual circle 22, which is defined by a virtual projection of the seat orifice 128D onto the metering disc surface 10C.

Referring to FIG. 2B, a configuration of the first and second walls 16 and 17B is shown in an aerial view of the metering orifice disc 10. In this preferred configuration, the first wall 16 forms a preferably semicircular sector about both the metering orifice 12 and the second wall 17B. The first wall 16 has at least one inner end and preferably two inner ends 16A1 and 16A2 farthest from the center of a metering orifice 12 and an outer end 16A3 that is closest to the center of the metering orifice 12. The second wall 17B is located along an axis R1, R2, R3 . . . Rn extending radially from the longitudinal axis A-A. The second wall 17B has an inner end 16B1 farthest from the center 13 of the metering orifice 12 and an outer end 16B2 closest to the center 13 of the metering orifice 12. The utilization of the first and second walls 16 and 17B provides for the two flow channels 14A and 14B converging towards the metering orifice 12. Each flow channel is separated between the first wall 16 and second wall 17B by a plurality of distances $A_{MAX}, A_2, A_3 \ldots A_N$ (where $A_N$ is generally equal to the minimum distance $A_{MIN}$) between them. Suffice to note, each flow channel has a maximum inner distance $A_{MAX}$ between the respective farthest points 16A1, 16A2 and 16B1 (from the center of the metering orifice 12) of the walls 16A and 16B and a minimum distance $A_{MIN}$ therebetween the closest points 16A3 and 16B2 to the center 13 of the metering orifice. The reduction in the distances $A_{MAX}$ and $A_{MIN}$ is greater than 10 percent. Preferably, the distance $A_{MIN}$ is generally the sum of 50 microns and the maximum linear distance extending across the confronting internal wall surfaces 11 of the metering orifice 12. This change in the distances between the maximum points and minimum points of the walls reflects a reduction in the flow area of each channel that reaches a constant value proximate the metering orifice or contiguous to the perimeter of the metering orifice. It is believed that the reduction in cross-sectional area of the flow channel induces the flow of fuel from the seat orifice 128 to accelerate towards the metering orifice 12, thereby inducing increased atomization of the fuel as the fuel leaves the metering orifice and the outlet of the fuel injector. Preferably, the flow channel is defined by at least three surfaces: (1) the generally vertical wall surface of the first wall portion 16A, (2) the third surface 10C of the metering orifice 10, and (3) the generally vertical wall surface of the second wall portion 16B. In the most preferred embodiment, a fourth surface is provided by the generally planar seat surface 128E of the seat 128 such that the flow channel has a generally rectangular cross-section generally parallel to the longitudinal axis A-A.

In the preferred embodiment of FIGS. 2A or 2C, each metering orifice 12 is symmetrically disposed about the longitudinal axis in the preferred embodiment of FIGS. 2A and 2B so that the centerline of each metering orifice 12 is generally disposed equiangularly on a virtual bolt circle 20 outside the virtual projection 22 of the seat orifice 128D about the longitudinal axis A-A such that the arcuate distances d1 and d2 between the centers 13 of adjacent metering orifices are generally equal; each metering orifice 12 is a chemically etched orifice having an effective diameter of about 150-200 microns with the overall diameter of the metering orifice disc 10 being a stainless steel disc of about 5.5 millimeters with an overall thickness of about 100-400 microns and a depth between the recessed surface 10C and the first surface 10A of about 75-300 with preferably 100 microns. As used herein, the term "effective diameter" denotes a diameter of an equivalent circular area for any non-circular area of the metering orifice.

Referring to FIG. 2C, a perspective view of another preferred metering orifice disc 10 that utilizes a unitary flow divider 17 with another flow divider 18 is illustrated. In this embodiment, the flow divider 17 can include a perimeter 17D smaller than a virtual projection of the seat orifice 128D onto the third surface 10C of the metering disc 10. A plurality of pairs of metering orifice 12 is formed through the metering orifice disc 10 on a recessed third surface 10C. Each pair of metering orifice 12 includes an inner metering orifice 12A and outer metering orifice 12B located generally outward of the longitudinal axis A-A and the inner metering orifice 12A. The metering orifices 12A and 12B are preferably located radially outward of a virtual projection 23 of the seat orifice 128D onto the disc 10. The metering orifices 12A and 12B extend through the metering orifice disc 10 along the longitudinal axis so that the internal wall surface of the metering orifice 12A or 12B defines respective centers 13A and 13B. Although the metering orifices 12A and 12B are illustrated preferably as having the same configuration, other configurations are possible such as, for example, a non-circular flow opening with different sizes of the flow opening for one or more metering orifices.

The inner metering orifice 12A includes at least one flow channel 14A, and the outer metering orifice 12B includes at least one flow channel 15A formed by first wall 16, second wall 17B and third wall 18. In the preferred embodiments, the inner metering orifice 12A includes two inner flow channels 14A and 14B provided by first wall 16 with second wall 17B; and the outer metering orifice 12B includes two outer flow channels 15A and 15B provided by first wall 16 and third wall 18. The first wall 16 surrounds the metering orifices 12A and 12B. The second wall 17B, acting as a flow divider, is disposed between each metering orifice 12A and the longitudinal axis A-A. The second wall 17B is preferably in the form of a teardrop shape but can be any suitable shape as long as the second wall 17B divides a fuel flow proximate the longitudinal axis A-A into two flow channels 14A and 14B and recombine the fuel flow proximate the metering orifice 12A at a higher velocity than as compared to the velocity of the fuel at the portion of the second wall 17B closest to the longitudinal axis A-A. The third wall 18 is preferably in the form of a generally deltoid shape that further sub-divides the fuel flow F radially outward of the inner metering orifice 12A and recombines the divided flow proximate the outer metering orifice 12B.

Figure 2D:
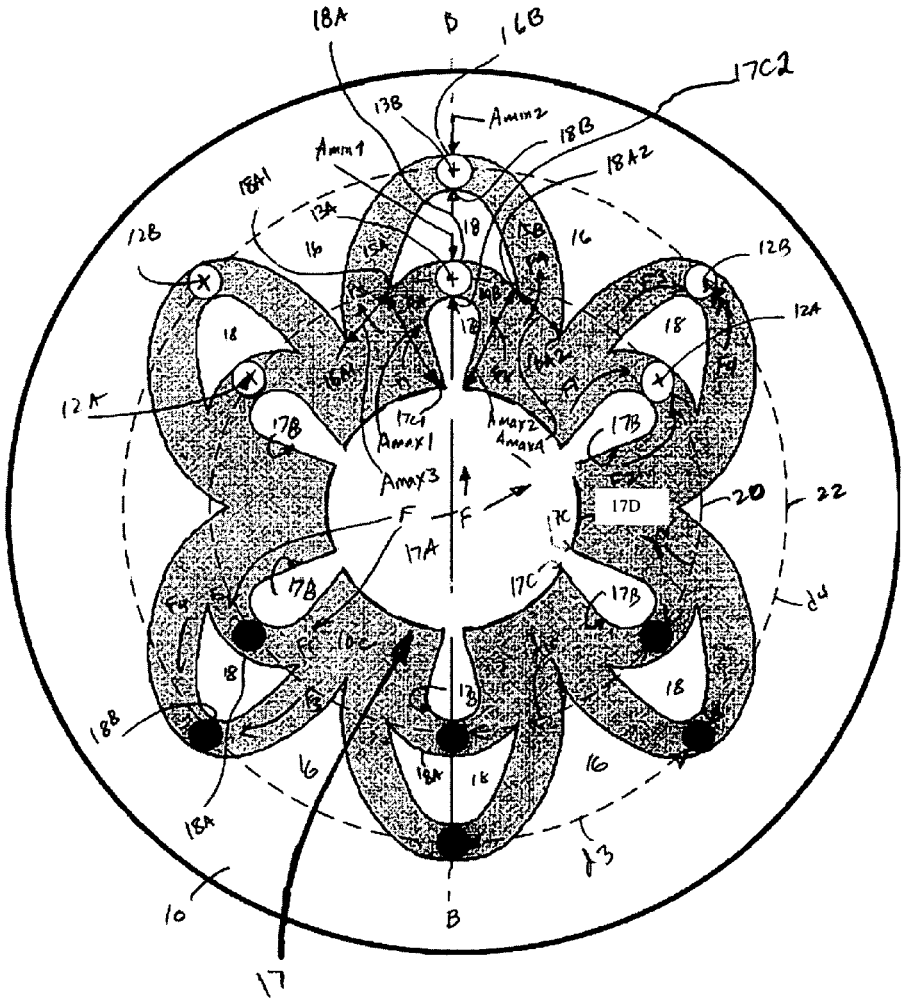
FIG. 2D illustrates a plan view of the metering orifice disc of FIG. 2B.

While FIG. 2C illustrates a metering orifice disc that has its metering orifices disposed generally equiangularly about the longitudinal axis, the preferred embodiment of FIG. 2D illustrates a metering orifice disc 10 with its metering orifices disposed in a non-equiangularly manner about the longitudinal axis A-A. This configuration is similar to the embodiment described and illustrated in FIG. 2C in that the first wall 16 forms a semicircular sector about both the metering orifices 12A, 12B and the second and third walls 17 and 18 to define inner and outer channels 14 and 15.

The inner channel 14, which includes channels 14A and 14B, is defined by the first wall 16, second wall 17B and third wall 18. By way of example, a description of the metering orifices 12A and 12B aligned along axis B-B in FIG. 2D is provided. In this configuration, the first wall 16 has inner portions 16A1 and 16A2 closest to the longitudinal axis A-A. The second wall 17B has an inner portion 17C1 closest to the longitudinal axis A-A. The third wall 18 also has two inner portions closest to the longitudinal axis A-A. The first wall 16 has an outer portion 16B closest to the center 13B of the outer metering orifice 12B. The second wall 17B has an outer portion 17C2 closest to the center 13A of the inner metering orifice 12A. The third wall 18 has an outer portion 18B closest to the center 13B of the outer metering orifice 12B.

The first inner channel 14A includes a first inlet area defined partially by first distance $A_{MAX1}$ and a flow recombinant area defined partially by first minimum distance $A_{MIN1}$. The first distance $A_{MAX1}$ can be the distance between inner portions 17C1 and 18A1 of the respective second wall 17B and third wall 18. The second inner channel area 14B includes a second inlet area defined partially by first distance $A_{MAX2}$ and a flow recombinant area defined partially by a first minimum distance $A_{MIN1}$ between outer portion 17B and the inner portion 18A. The second distance $A_{MAX2}$ can be the distance between inner portions 17C1 and 18A2 of the respective second and third walls 17 and 18. Each of the first and second inner channels 14A and 14B extends generally radially towards the outer metering orifice 12A such that a cross-sectional area of the channel between the walls 16 and 18 is preferably reduced as each channel converges upon the metering orifice 12A.

The first outer channel 15A includes a third inlet area defined partially by third distance $A_{MAX3}$ and a flow recombinant area defined partially by a second minimum distance $A_{MIN2}$. The third distance can be the distance between the inner portions 16A1 and 18A1 of the first and third walls 16 and 18. The second outer channel 15B includes a fourth inlet area defined partially by fourth distance $A_{MAX4}$ and a flow recombinant area defined partially by second minimum distance $A_{MIN2}$. The fourth distance can be the distance between the inner portions 16A2 and 18A2 of the first and third walls 16 and 18. Each of the first and second outer channels 15A and 15B extends generally radially towards the outer metering orifice 12B such that a maximum cross-sectional area of each of the channel between the walls 16 and 18 is reduced to a minimum cross-sectional area as the channel converges upon the metering orifice 12B. As used herein the maximum cross-sectional area is the product of the maximum distance ($A_{MAX1}$, $A_{MAX2}$, $A_{MAX3}$, or $A_{MAX4}$) and the thickness "t" between third surface 10C and first surface 10A, and the minimum cross-sectional area is the product of the minimum distance ($A_{MIN1}$, or $A_{MAX2}$) and the thickness t. It is believed that the reduction in cross-sectional area of the flow channel induces the flow of fuel from the seat orifice to accelerate towards the metering orifice. Preferably, the flow channel is defined by at least three surfaces: (1) the generally vertical wall surface of the first wall portion 16A, (2) the third surface 10C of the metering orifice 10, and (3) the generally vertical wall surface of the second wall portion 16B. In the most preferred embodiment, a fourth surface is provided by the generally planar seat surface 128E of the seat 128A such that the flow channel has a generally rectangular cross-section generally parallel to the longitudinal axis A-A.

Preferably, the reduction in the distance $A_{MAX1}$ or $A_{MAX2}$ to $A_{MIN1}$ is about at least 10%; and the reduction in $A_{MAX3}$ or $A_{MAX4}$ to $A_{MIN2}$ is at least 10% with the thickness t being generally constant. Preferably, the distance $A_{MIN1}$ or $A_{MIN2}$ is generally the sum of 50 microns and the maximum linear distance extending across the confronting internal wall surfaces of the metering orifice 12A or 12B.

In the preferred embodiment of FIG. 2C, each metering orifice 12A is symmetrically disposed about the longitudinal axis so that the centerline 13A of each metering orifice 12A is generally disposed equiangularly on a virtual bolt circle 20 about the longitudinal axis A-A; each metering orifice 12A or 12B is a chemically etched orifice having an effective diameter of about 150-200 microns with the overall diameter of the metering orifice disc 10 being a stainless steel disc of about 5.5 millimeters with an overall thickness of about 100-400 microns and a depth between the recessed surface 10C and the first surface 10A of about 75-300 with preferably 100 microns. As used herein, the term "effective diameter" denotes a diameter of an equivalent circular area for any non-circular area of the metering orifice.

In the preferred embodiment of FIGS. 2C and 2D, the metering orifices 12A and 12B are symmetrical about an axis B-B transverse to the longitudinal axis A-A so that a fuel spray emanating from the metering orifice disc 10 in an operational fuel injector is bi-symmetric to a plane defined by the longitudinal axis A-A and transverse axis B-B. Coincidentally, the centerline 13A of each metering orifices 12A can be generally on a first virtual bolt circle 20 in this preferred embodiment and the centerline 13B of each metering orifices 12B can be generally on a second virtual circle 22 outward of the first virtual circle 20. Both virtual circles 20 and 22 are outside of the virtual projection 23 of the seat orifice 128D onto the metering orifice disc 10. The metering orifices 12A can be located on the bolt circle 20 at various arcuate distances d3 or d4 between the centers of adjacent metering orifices, which can be the same magnitude or different magnitude depending on the desired spray targeting requirements. The metering orifices 12B can be located on the bolt circle 22 at various arcuate distances d3 or d4, which can be the same magnitude or different magnitude depending on the desired spray targeting requirements. Preferably, each metering orifice 12A or 12B is a chemically etched orifice having an effective diameter of about 150-200 microns with the overall diameter of the metering orifice disc 10 being a stainless steel disc of about 5.5 millimeters with an overall thickness of about 100-400 microns and a depth between the recessed surface 10C and the first surface 10A of about 75-300 with preferably 100 microns.

Although the respective metering orifice disc 10 described in FIG. 2A or 2C is provided with a basic flow channel configuration, other flow channel configurations can also be utilized such as, for example, the configurations disclosed in copending application Ser. No. 10/972,584, entitled "Fluidic Flow Controller Orifice Disc For Fuel Injector," by the same inventor and filed on the same date, which copending application is incorporated herein by reference in its entirety into this application.

The metering orifice disc 10 can be made by any suitable technique and preferably by at least two techniques. The first technique utilizes laser machining to selectively remove materials on the surface of the metering orifice disc 10. The second technique utilizes chemical etching to dissolve portions of the metallic surface of the metering orifice disc 10.

The techniques of making the metering orifice disc or valve seat, the detail of various flow channels and divider configurations for various metering discs or valve seat are provided in copending in copending applications Ser. Nos. 10/972,584 ; 10/972,585, now U.S. Pat. No. 7,306,172 ; 10/972,583, now U.S. Pat. No. 7,222,407 ; 10/972,652, now U.S. Pat. No. 7,299,997; and 10/972,651, now U.S. Pat. No. 7,344,090, which the entirety of the copending applications are incorporated herein by reference.

As described, the preferred embodiments, including the techniques of controlling spray angle targeting and distribution are not limited to the fuel injector described but can be used in conjunction with other fuel injectors such as, for example, the fuel injector sets forth in U.S. Pat. No. 5,494,225 issued on Feb. 27, 1996, or the modular fuel injectors set forth in U.S. Pat. Nos. 6,676,044 and 6,793,162, and wherein all of these documents are hereby incorporated by reference in their entireties.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

I claim:

1. A fuel injector comprising:

an inlet and an outlet and a passage extending along a longitudinal axis from the inlet to the outlet, the inlet communicable with a flow of fuel;

a seat disposed in the passage proximate the outlet, the seat including a sealing surface that faces the inlet and a seat orifice extending through the seat from the sealing surface along the longitudinal axis;

a closure member being reciprocally located between a first position displaced from the seat, and a second position contiguous the sealing seat surface of the seat to form a seal that precludes fuel flow past the closure member;

a metering orifice disc disposed between the seat and the outlet, the metering orifice disc including:

a generally planar surface;

a plurality of metering orifices that extends through the generally planar surface, the metering orifices being located radially outward of the seat orifice, each of the metering orifices having a center defined by the interior surface of the metering orifice through the disc;

a first wall having a first inner wall portion closest to the longitudinal axis and a first outer wall portion closest to the center of the metering orifice;

a second wall having a perimeter disposed about the longitudinal axis, the second wall including a plurality of projections that extend from the perimeter, each projection having a base and a free end, the base contiguous to the perimeter to define a second inner wall portion, the base confronting the first wall to define two channels that converge towards each metering orifice, each channel including a first distance between the first inner wall portion and second inner wall portion being greater than a second distance between the first outer wall portion and second outer wall portion.

2. The fuel injector of claim 1, wherein each projection comprises a transition portion disposed between the base and the free end.

3. The fuel injector of claim 2, wherein the at least one metering orifice comprises at least two metering orifices generally located along an axis extending radially away from the longitudinal axis and radially outward of the seat orifice, and the channel extends radially away from the longitudinal axis towards each of the at least two metering orifices.

4. The fuel injector of claim 3, wherein the channel comprises a plurality of cross-sectional areas generally perpendicular to the generally planar surface of the metering orifice disc, the plurality of cross-sectional areas reducing in magnitude as the channel extends toward each of the at least two metering orifices, each of the at least two metering orifices having a center defined by the interior surface of the metering orifice extending through the disc, the respective centers of the at least two metering orifices being located on the axis extending radially away from the longitudinal axis A-A.

5. The fuel injector of claim 4, the plurality of metering orifices includes at least two metering orifices diametrically disposed on a first virtual circle about the longitudinal axis A-A.

6. The fuel injector of claim 4, the plurality of metering orifices includes at least two metering orifices diametrically disposed on a second virtual circle about the longitudinal axis A-A.

7. The fuel injector of claim 6, wherein the plurality of metering orifices includes at least two metering orifices disposed at a first arcuate distance relative to each other on the second virtual circle, the second virtual circle surrounding both the first virtual circle and a virtual projection of the seat orifice onto the metering orifice disc.

8. The fuel injector of claim 5, wherein the plurality of metering orifices includes at least two metering orifices disposed at a first arcuate distance relative to each other on the first virtual circle.

9. The fuel injector of claim 3, wherein the plurality of metering orifices includes at least three metering orifices spaced at different arcuate distances on the first virtual circle.

10. The fuel injector of claim 3, wherein the channel comprises two flow channels for each metering orifice.

11. The fuel injector of claim 10, wherein the two flow channels are formed by a first wall and a second wall disposed on the generally planar surface of the metering orifice disc, the first wall circumscribing a portion of the second wall.

12. The fuel injector of claim 11, wherein the second distance comprises from 10% to 90% of the first distance.

13. The fuel injector of claim 5, wherein the flow channels are symmetric about the axis extending from the longitudinal axis to the center of a metering orifice disposed on the first virtual circle.

14. The fuel injector of claim 6, wherein the flow channels are symmetric about the axis extending from the longitudinal axis to the center of a metering orifice disposed on the second virtual circle.

15. The fuel injector of claim 5, wherein the flow channels are asymmetric about the axis extending from the longitudinal axis to the center of a metering orifice disposed on the first virtual circle.

16. The fuel injector of claim 6, wherein the flow channels are asymmetric about the axis extending from the longitudinal axis to the center of a metering orifice disposed on the second virtual circle.

17. A method of atomizing fuel flow through at least one metering orifice of a fuel injector, the fuel injector having an inlet and an outlet and a passage extending along a longitudinal axis therethrough the inlet and outlet, the outlet having a seat and a metering orifice disc, the seat having a seat orifice, a closure member that occludes a flow of fuel through seat orifice, the metering orifice disc being disposed between the seat and the outlet, the metering orifice disc including at least one metering orifice that extends along the longitudinal axis through the generally planar surface to define a centerline, the method comprising:

flowing a portion of the fuel to a first surface of the metering orifice disc closest to the closure member;

directing the portion of the fuel to the generally planar surface area spaced from the first surface and farther from the closure member; and flowing the portion of fuel away from the longitudinal axis to the at least one metering orifice through two flow channels, each channel having a first cross-sectional area located proximate the longitudinal axis and a second cross-sectional area spaced farther away from the longitudinal axis, the second cross-sectional area being smaller than the first cross-sectional area.

18. The method of claim 17, wherein the directing comprises providing a generally circular member between the seat orifice and the generally planar surface of the metering orifice disc within a perimeter defined by a projection of the seat orifice onto the metering orifice disc.

19. The method of claim 18, wherein the flowing comprises dividing a flow of fuel through the seat orifice into at least two fuel flow paths that extend away from the longitudinal axis A-A.

20. The method of claim 19, wherein the flowing comprises combining the flow paths proximate each metering orifice located outward of the seat orifice so that the fuel flow paths are atomized proximate the outlet of the fuel injector.

21. The method of claim 20, wherein a portion of the fuel flow is divided and recombined symmetrically about an axis intersecting the centerline of the metering orifice.

22. The method of claim 18, wherein the flowing comprises dividing the flow of fuel away from the longitudinal axis into a first flow path proximate a first metering orifice and a second flow path proximate a second metering orifice disposed outward of the first metering orifice.

23. The method of claim 22, wherein the dividing comprises splitting the flow of fuel into a first pair of fuel flow paths proximate the first metering orifice and a second pair of fuel flow paths proximate the second metering orifice radially outward of the first metering orifice and the longitudinal axis A-A.

24. The method of claim 23, wherein the splitting comprises combining the fuel flow paths proximate each metering orifice so that the fuel flow paths are atomized proximate the outlet of the fuel injector.

25. The method of claim 24, wherein each flow path comprises a channel having a flow divider unitary with the member.

* * * * *